United States Patent [19]

Boujet

[11] 4,099,145

[45] Jul. 4, 1978

[54] MICROWAVE MODE TRANSDUCER

[75] Inventor: Jean-Pierre Boujet, Chatillon, France

[73] Assignee: Compagnie Industrielle des Telecommunications Cit-Alcatel S.A., Paris, France

[21] Appl. No.: 723,856

[22] Filed: Sep. 16, 1976

[30] Foreign Application Priority Data

Sep. 24, 1975 [FR] France ..... 75 29258

[51] Int. Cl.[2] ..... H01P 1/16

[52] U.S. Cl. ..... 333/21 R; 333/98 M

[58] Field of Search ..... 333/21 R, 98 M

[56] References Cited

U.S. PATENT DOCUMENTS

| | | | |
|---|---|---|---|
| 3,321,720 | 5/1967 | Shinada | 333/21 R X |
| 3,668,565 | 6/1972 | Tuchen | 333/21 R X |
| 3,918,010 | 11/1975 | Marchalot | 333/21 R X |

*Primary Examiner*—Paul L. Gensler

*Attorney, Agent, or Firm*—Sughrue, Rothwell, Mion, Zinn and Macpeak

[57] ABSTRACT

The invention relates to a microwave mode transducer for changing between the rectangular $TE_{10}$ mode and the semi-circular or circular $TE_{01}$ mode. It comprises a microwave mode transducer comprising a semi-circular wave guide and a rectangular wave guide, the wave guides having substantially parallel longitudinal axes and being separated by a web which forms at least a part of the plane wall of the semi-circular guide and one of the smaller side walls of the rectangular guide, the guides being coupled by orifices in the web which orifices are substantially contiguous and are substantially as wide at their maximum width as the wall of the rectangular guide in which they are made.

6 Claims, 7 Drawing Figures

MICROWAVE MODE TRANSDUCER

BACKGROUND OF THE INVENTION

1. Field of the Invention

The present invention relates to a microwave mode transducer for changing the rectangular $TE_{10}$ mode into the circular or semi-circular $TE_{01}$ mode and vice versa, particularly in the frequency range extending from a few GHz to more than 100 GHz.

2. Description of the Prior Art

In this type or transducer energy propagating in the rectangular $TE_{10}$ mode is transformed into circular $TE_{01}$ mode for example, to be transmitted over a distance by a large diameter circular guide e.g. 50 to 70 mm, or a helical or other guide, having very low losses in the circular $TE_{01}$ mode and therefore not greatly attenuating the energy transmitted. This transmission mode is used particularly for distances greater than 100 meters. A reverse transducer, i.e. from the circular $TE_{01}$ mode to the rectangular $TE_{10}$ mode is used at the other end of the connection by circular or other guide connection. Such transducers for changing from the rectangular $TE_{10}$ mode to the semi-circular or circular $TE_{01}$ mode, can be used in semi-circular wave guide diplexers employed in a multiplexed communications connection formed by circular wave guides; these diplexers are, for example, similar to those described in French Pat. No. 2,246,089, in the Applicant's name. These transducers can be used for extracting the frequency sub-bands of a semi-circular diplexer and/or as measurement couplers for semi-circular wave guide structures and/or, even, as couplers between rectangular guides and circular guides.

Such transducers also enable transmitters to be connected to aerials in microwave stations, the rectangular $TE_{10}$ mode often being used.

Several transducers of this type are known:

The "Marie" type transducer in which electromagnetic fields are transformed into the rectangular $TE_{20}$ mode and into the rectangular $TE_{22}$ mode and lastly into the circular $TE_{01}$ mode. The "Marie" transducer described particularly in the article "A new $TE_{10}$ - $TE_{01}{}^{0}$ mode transducer mm — waves", published on p. 73–75, "Microwave Journal" of February, 1970, has a complex structure and large dimensions which it is difficult to determine precisely.

A transducer having a variable interior cross-section; an originally rectangular cross-section is transformed to obtain a transducer having an intermediate triangular then a semi-circular, then circular cross-section. They are difficult to produce and must be equipped with spurious mode filters, spurious modes occurring at the transducers.

Another transducer of this type can be constituted by a semi-circular guide coupled to a cylindrical or rectangular resonant cavity. In this transducer coupling is effected by a single orifice and the semi-cylindrical guide is closed by a short-circuit which concentrates energy at a coupling orifice. This transducer operates like a selective band-pass filter.

Preferred embodiments of the present invention avoid these disadvantages.

SUMMARY OF THE INVENTION

The present invention provides a microwave mode transducer comprising a semi-circular wave guide and a rectangular wave guide, the wave guides having substantially parallel longitudinal axes and are separated by a web which forms at least part of the plane wall of the semi-circular guide and one of the smaller side walls of the rectangular guide, the guides being coupled by orifices in the web which orifices are substantially contiguous and are substantially as wide at their maximum width as the wall of the rectangular guide in which they are made.

Two embodiments of the present invention are described by way of example with reference to the accompanying drawings in which.

DESCRIPTION OF PREFERRED EMBODIMENTS

Figure 1:
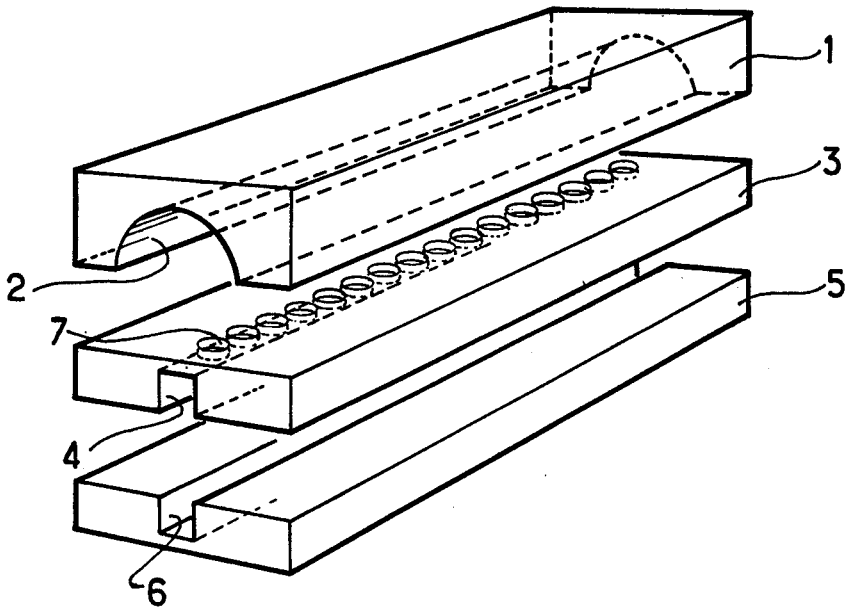
FIGS. 1 and 2 are an exploded view and a cross-section of a transducer for changing between the rectangular $TE_{10}$ mode and the semi-circular $TE_{01}$ mode.
Figure 2:
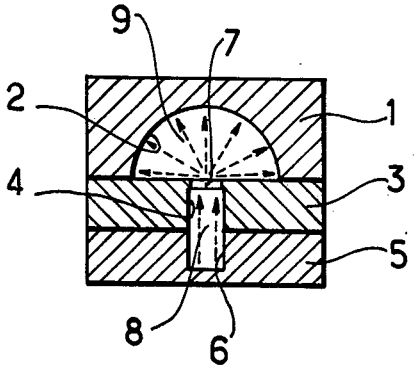
Figure 3:
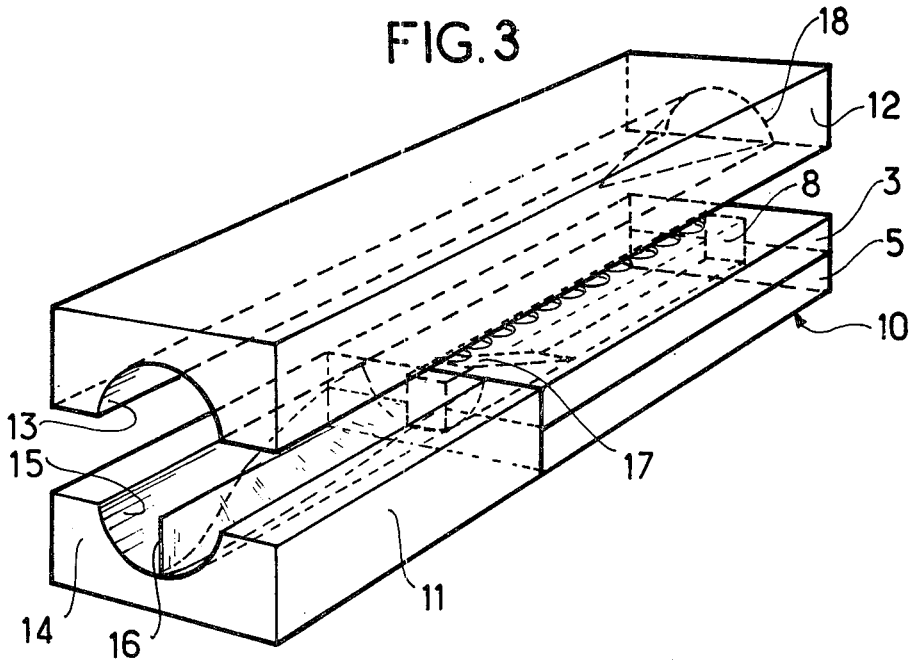
FIG. 3 is an exploded view of a transducer for changing between the rectangular $TE_{10}$ mode and the circular $TE_{01}$ mode.

FIGS. 1 and 2 show a microwave mode transducer of generally elongate rectangular shape and constituted by a sandwich assembly of three metallic blocks 1, 3 and 5 which may be held together by brazing, welding or by screws. Each of the blocks has a generally rectangular shape and they all have the same length and the same width. The block 1 (shown as the upper block in the drawing) has a channel 2 formed in the face of the block 1 which is in contact with the block 3. The channel 2 is of semi-circular section running along the entire length of the block 1.

The middle block 3 and the remaining block 5 have respective channels 4 and 6 of rectangular section running along their entire lengths. The rectangular channels 4 and 6 are of the same width and preferably of identical depth and their open sides are in register so that when the blocks 3 and 5 are assembled the channels 4 and 6 form a single rectangular wave-guide 8 through the assembly. The block 3 also has a row of substantially contiguous orifices 7 of substantially the same width as the channel 4 passing through the thin web at the back of the channel 4 and communicating with the semi-circular section channel 2. (These orifices 7 are of circular section but they could be of some other section e.g. square, rectangular or oblong). The block 3 closes the open side of the semi-circular channel 2 and thereby forms the base or plane wall of a semi-circular wave guide 9. The semi-circular wave guide 9 and the rectangular wave guide 8 are thus coupled for total reciprocal energy transfer via the orifices 7 disposed in one of the shorter sides of the rectangular wave guide 8.

The large size given to the orifices 7 and the small thickness of the web through which they pass make it possible to limit the number of orifices needed to obtain total energy transfer from one of the guides to the other. This disposition gives the transducer a practically constant energy transfer characteristic over a very wide range of operating frequencies.

In this structure the coupling between the rectangular guide and the semi-circular guide is magnetic. Only the $TE_{Om}$ modes have a longitudinal magnetic component and hence only the $TE_{Om}$ modes can be excited by the coupling system formed by the orifices. The distribution of the transverse magnetic fields in the transducer is illustrated by dashed arrows in FIG. 2.

One electric particularity of this structure is that the blocks are assembled together in zones where the current is zero: there is no current at the centre of the long sides defining the junction between the blocks 3 and 5.

To prevent the generation of spurious modes, e.g. the $TE_{20}$ mode and the $TE_{22}$ mode, due particularly to the large dimensions of the coupling orifices and to imperfections in the semi-circular structure and which can be particularly excited at frequencies close to their cut-out frequencies and at which spurious resonances occur thus forming absorption points in the transmission, the radius $r$ of the semi-circular guide and the dimensions of the rectangular guide particularly the long side $a$ of the cross-section of the rectangular guide are defined with precision. $a$ and $r$ are chosen such that:

$$r + a + e < 600/F\max,$$

where $e$ is the thickness of the web, $e$, $a$ and $r$ are expressed in mm and $F$max, which is the maximum frequency of the useful transducer band is expressed in GHz; 600 is a coefficient giving approximately twice the speed of light, in thousands of kilometers per second.

Large coupling orifices promote the generation of the $TE_{20}$ mode, particularly at the beginning of this mode, thus giving a more or less high absorption peak in the energy transfer characteristic. Indeed, the size of these coupling orifices gives a degree of "transparency" to the coupling and results in the creation of a virtual rectangular guide in place of the rectangular guide 8 and which has a long side that is longer than the length $a$ of the guide 8, this virtual guide overlapping onto the semi-circular guide 9.

The choice of values for $r$ and $a$ according to the condition given above enables the generation of this spurious $TE_{20}$ mode to be raised above the value of the maximum frequency of the useful transducer band.

By way of and example, for a transducer operating in the 31 to 38 GHz frequency band where $e = 0.5$ mm, $r = 8.29$ mm and $a = 6.8$ mm and $F\max = 38$ GHz, the generation of the spurious $TE_{20}$ mode begins at 38.5 GHz.

For a transducer in the 10.7 to 11.7 GHz frequency band, where $e = 1$ mm, $r = 25$ mm and $a = 20.5$ mm and $F\max = 11.7$ GHz, the generation of the $TE_{20}$ mode then begins at 12.9 GHz.

The values of $e$ and $r$, chosen to meet this condition, must nevertheless comply with the known equation: $1.64\,r = 2a$, for maximum transfer from the semi-circular $TE_{01}$ mode to the rectangular $TE_{10}$ mode and vice versa. This known equation defines the phase conditions for this transfer.

With a view to proper adaptation, the distance between the axes of the orifices plus the thickness of the web must be equal to a quarter of the average guided wavelength in the useful band. An infinitely small coupling orifice with an infinitely thin web would produce a coupling which varies in the frequency band in proportion to the guided wavelength.

This variation can be compensated by increasing the thickness of the web and/or by increasing the dimensions of the orifices.

As the thickness of the web is taken into account in the distance between orifices, a compensation by the thickness would result in closer orifices having smaller dimensions.

Further, a thin web makes it possible to space out the orifices and hence to make then larger. These larger orifices have a polarizability (coupling coefficient) which varies inversely with the guided wavelength.

In practice, the structure will have coupling orifices with a width close to the width of the rectangular guide and a maximum axial spacing limited by the adaption of the coupling system to obtain a flat transfer characteristic, with little attenuation over wide frequency bands.

The web will be as thin as possible, thus enabling the number of orifices to be reduced and an extremely flat transfer characteristic to be obtained.

The thickness of the web will simply be limited by mechanical production requirements of the orifices; it will be in the order of a tenth of a millimeter to 2 mm according to the useful transducer band.

For example to obtain a transducer having a transfer characteristic with a variation of less than 0.1 dB over the frequency band of 30 to 38 GHz when $r = 8.29$ mm and $a = 6.8$ mm, a thickness $e = 0.5$ mm needs about 50 coupling orifices spread over about 140 mm while a smaller thickness $e = 0.2$ mm only needs about 20 coupling orifices spread over about 60 mm.

The small size of this transducer is due to: the thinness of the coupling web and the large possible dimensions of the coupling orifices which permits the number of orifices to be small.

This embodiment makes it possible to reduce manufacturing costs.

Being small in number, the orifices are formed easily with high precision and the shorter coupling web can be machined to a very precise thickness.

FIGS. 3 to 7 show a transducer for changing between the rectangular $TE_{10}$ mode and the circular $TE_{01}$ mode which is constituted by a transducer 10 for changing between the rectangular $TE_{10}$ and the semi-circular $TE_{01}$ mode, according to FIGS. 1 and 2, followed by a transducer 11 for changing between the semi-circular $TE_{01}$ mode and the circular $TE_{01}$ mode. The same references as those used in FIGS. 1 and 2 designate identical elements.

The block provided with the semi-circular channel (1 in FIG. 1) extends along the length of the two transducers 10 and 11. It is here designated as 12, the channel being 13.

Figure 4:
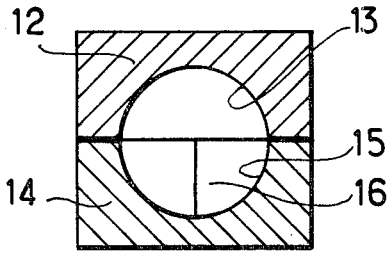
FIGS. 4 to 7 are various cross-sections of the transducer of FIG. 3.
Figure 5:
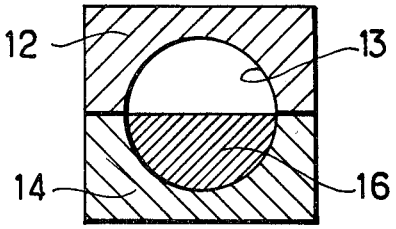

A block 14 forms the remainder of the transducer 11 and has a channel 15 provided with a tongue 16. At a "mouth" end distant from transducer 10 the channel 15 is semi-circular with the tongue 16 acting as a radial barrier dividing the semi-circular channel 15 into two substantially equal quadrants (FIG. 4). Moving away from the "mouth" end the channel 15 remains of semi-circular section but the tongue 16 which is of varying cross-section, occupies a progressively increasing sector of the channel 15 until at a "throat" end adjacent the transducer 10 it completely blocks the channel (FIG. 5). The tongue 16 has a shape which is reminiscent of the stern of an overturned ship's hull and, in conjunction with the facing semi-circular groove 13, provides the transition from the semi-circular wave guide at the "throat" end to the circular wave guide at the "mouth" end. The progressive variation of the sector occupied by the tongue 16 is preferably linear with distance along the guide.

Figure 6:
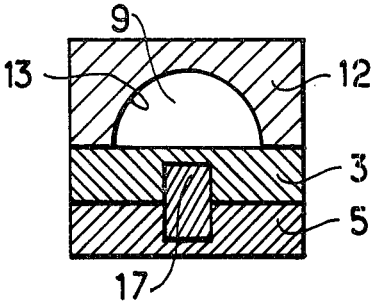
Figure 7:
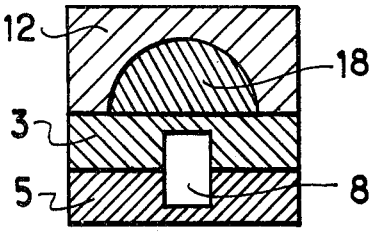

The transducer 10 is identical to that in FIGS. 1 and 2. It is equipped at its end joining the transducer 11 end with a short adapted rectangular plug 17 inserted at this end in the rectangular guide limited by the blocks 3 and 5 (FIG. 6). At the other end of the transducer 10 a semi-circular conical plug 18 is installed in the semi-circular guide to stop it (FIG. 7) and the rectangular guide 8 constitutes the only access (input or output).

The blocks are assembled by brazing, by welding or by screws as in the FIG. 1 embodiment.

Thus the combined transducer 10–11 enables the passage from a circular wave guide to a rectangular wave guide or vice versa.

Transducers according to FIGS. 1–2 and FIGS. 3–7 can be used for extracting frequency sub-bands from a diplexer whose structure is that of a semi-circular wave guide or as measurement couplers for semi-circular wave guide structures or even as couplers connecting rectangular wave guides to circular wave guides. Of course, if the transducer access wave guide is different from the rectangular wave guide which must be connected to it, a further transducer is preferably integrated in the transducer structure. Such further transducer, known per se and not shown, is obtained by making the cross-section of one of the channels 4 and 6 variable, the bottom of the channel forming a staircase structure in the vicinity of the rectangular access end. In the case of a connection between the transducer 10 and a semi-circular guide having a different cross-section from the semi-circular transducer access, a semi-circular connection cone connects the two cross-sections; in the case where these cross-sections are identical, connection is direct.

These transducers have good electric performances. They have low insertion losses, low spurious mode levels, a low standing wave ratio and enable precise electric measurements.

While embodiments of the invention have been described it is evident that without going beyond the scope of the invention, details can be modified and various means can be replaced by other technically equivalent means therein.

What is claimed is:

1. A microwave mode transducer comprising a semi-circular wave guide, a rectangular wave guide coupled on its small side to the semi-circular wave guide, the improvement wherein: said semi-circular wave guide being devoid of a planar diametrical wall, one of the walls delimiting the small side of the rectangular wave guide constitutes the plane wall of the semi-circular wave guide, and said plane wall is pierced with orifices approximately joined to each other and opening commonly to said semi-circular wave guide, and being of a crosswise dimension approximately equal to the small side of the rectangular wave guide to constitute the coupling wall between the two guides.

2. The transducer according to claim 1, wherein the dimensions of the semi-circular and rectangular wave guides are defined by the equation $$r + a + e < 600/F\,\mathrm{max}$$

where $r$ is the linking radius of the semi-circular section, $a$ is the large side of the rectangular wave guide section, and $e$ is the thickness of the coupling wall, and wherein $e$, $a$ and $r$ are in millimeters and $F$max being the maximal frequency of the transition frequency band and being in GHz.

3. The transducer according to claim 2, wherein said coupling wall has a thickness which varies from 0.1 mm to 2 mm depending on the transition on the transducer band-pass.

4. The transducer according to claim 1, wherein it further comprises a wave guide of variable section having at its ends a semi-circular section and a circular section respectively and having an inside sector of variable opening from a zero angle to an angle of 180° on its length, the guide of variable section being connected on the side of its semi-circular section to the guide with semi-circular section as an extension thereof.

5. The transducer according to claim 2, wherein it further comprises a wave guide of variable section having at its ends a semi-circular section and a circular section respectively and having an inside sector of variable opening from a zero angle to an angle of 180° on its length, the guide of variable section being connected on the side of its semi-circular section to the guide with semi-circular section as an extension thereof.

6. The transducer according to claim 3, wherein it further comprises a wave guide of variable section having at its ends a semi-circular section and a circular section respectively and having an inside sector of variable opening from a zero angle to an angle of 180° on its length, the guide of variable section being connected on the side of its semi-circular section to the guide with semi-circular section as an extension thereof.

* * * * *